US009431230B2

(12) United States Patent
Baba

(10) Patent No.: US 9,431,230 B2
(45) Date of Patent: Aug. 30, 2016

(54) METHOD OF EXTRACTING IONS WITH A LOW M/Z RATIO FROM AN ION TRAP

(71) Applicant: DH Technologies Development Pte. Ltd., Singapore (SG)

(72) Inventor: Takashi Baba, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 57 days.

(21) Appl. No.: 14/367,261

(22) PCT Filed: Nov. 28, 2012

(86) PCT No.: PCT/IB2012/002524

§ 371 (c)(1),
(2) Date: Jun. 20, 2014

(87) PCT Pub. No.: WO2013/098600

PCT Pub. Date: Jul. 4, 2013

(65) Prior Publication Data

US 2015/0255264 A1 Sep. 10, 2015

Related U.S. Application Data

(60) Provisional application No. 61/580,346, filed on Dec. 27, 2011.

(51) Int. Cl.
*H01J 49/42* (2006.01)

(52) U.S. Cl.
CPC ..... *H01J 49/427* (2013.01); *H01J 49/4225* (2013.01); *H01J 49/4295* (2013.01)

(58) Field of Classification Search
CPC ... H01J 49/004; H01J 49/427; H01J 49/4275
See application file for complete search history.

(56) References Cited

U.S. PATENT DOCUMENTS

| | | | | |
|---|---|---|---|---|
| 6,392,225 | B1 * | 5/2002 | Schwartz | H01J 49/063 250/282 |
| 8,080,788 | B2 * | 12/2011 | Stoermer | H01J 49/0072 250/281 |
| 2007/0120053 | A1 | 5/2007 | Loboda | |
| 2009/0121126 | A1 | 5/2009 | Collings et al. | |
| 2010/0237237 | A1 * | 9/2010 | Green | H01J 49/004 250/283 |
| 2014/0145095 | A1 * | 5/2014 | McLuckey | H01L 49/0031 250/489 |

FOREIGN PATENT DOCUMENTS

| | | |
|---|---|---|
| WO | 03-041107 | 5/2003 |
| WO | 2004-083805 | 9/2004 |

OTHER PUBLICATIONS

International Search Report from International Patent Application No. PCT/IB2012/002524, date Apr. 29, 2013.

* cited by examiner

*Primary Examiner* — Jack Berman

(57) ABSTRACT

In a mass spectrometer, a method for trapping ions includes providing at least first and second multipole rod sets positioned in tandem, introducing a plurality of ions into the first rod set, applying an RF potential to at least one of said rod sets to generate a radial trapping potential within said rod sets, applying a radial DC potential to said first rod set so as to modulate said radial trapping potential set as a function of m/z of said ions, and applying a DC potential between said two rod sets to provide an axial bias potential between said two rod sets. The method can further comprise selecting an axial barrier potential to selectively extract ions having an m/z ratio less than a threshold from said first rod set into said second rod set.

14 Claims, 14 Drawing Sheets

METHOD OF EXTRACTING IONS WITH A LOW M/Z RATIO FROM AN ION TRAP

RELATED APPLICATION

This application claims priority to U.S. provisional application No. 61/580,346 filed Dec. 27, 2011, which is incorporated herein by reference in its entirety.

INTRODUCTION

The present teachings generally relate to non-resonant methods and systems for extracting trapped ions in a mass spectrometry system.

Conventional methods of mass spectrometry that employ collision induced dissociation ("CID") can have a number of shortcomings, specifically as relating to protein analysis or proteomics. For example, in proteomics, it is difficult to study post-translational modifications, such as glycosylation and phosphorylation, using conventional CID methods because post-translational moieties can be lost from the protein backbone in collisional fragmentation of the protein ions.

After initial difficulties, electron capture dissociation ("ECD"), and electron transfer dissociation ("ETD"), herein collectively referred to as "ExD" technologies, are now being increasingly implemented in high-throughput proteomics analysis. But ExD methods suffer from efficiency problems, e.g., caused by remaining precursor ions after the reaction. Long term exposure of precursor ions to reagents, i.e., electrons (ECD case) or reagent ions (ETD case), can increase the dissociation of the precursor ions. Notwithstanding, the total yield of product ions can decrease because the product ions can also react with electrons or reagents ions.

Product ions with low and high m/z ratios are often present in a mass spectrometry system and precursor ions often have medium m/z ratios relative to the product ions in a system.

Conventionally, low m/z ions are mass selectively extracted from a reaction cell with resonant excitation for subsequent analysis But such resonant extraction is likely to cause CID of the extracted ions, which can lead to the loss of product ions. Further, the ions produced via CID are typically different than those generated by ExD, which can render spectral analysis difficult.

Therefore it is desirable to have improved methods and systems for ion trapping and extraction, e.g., for trapping and selectively extracting ions from an ExD reaction cell.

SUMMARY

In a mass spectrometer, a method for trapping ions is disclosed that can comprise providing at least first and second multipole rod sets positioned in tandem, applying an RF (radio frequency) potential to at least one of said rod sets to generate a radial trapping potential within at least the first rod set, applying a DC potential (herein referred to as radial DC potential) to said first rod set to generate a radial DC field so as to modulate said radial RF trapping potential as a function of m/z of said ions, applying a DC potential (herein referred to as axial DC potential) between said two rod sets to provide an axial bias potential between said two rod sets, and introducing a plurality of ions into said first rod set. The DC bias potential can function as an extractive potential for first group of ions and as a barrier potential for a second group of ions having an opposite polarity relative to the first group. In some embodiments, the DC bias potential can be at least about 0.5 volts (V), e.g., about 1 volt (V). The term radial field is used herein to refer to an electromagnetic field whose field vectors are primarily directed along directions substantially orthogonal to a longitudinal axis of the trap (e.g., an axis along which ions are introduced into the trap). In some cases, some field vectors of a radial field may have components along the axial direction, but such axial field components have generally magnitudes that are significantly less than that of the radial components.

In some embodiments, the radial DC potential can modulate the radial RF trapping potential within said first rod set such that ions within said first rod set having an m/z less than a selected threshold are capable of entering said second rod set, e.g., under the influence of the axial potential. In some embodiments, the radial DC potential can modulate the radial RF trapping potential within said first rod set such that ions within said first rod set having an m/z greater than said threshold are trapped within said first rod set. The radial DC potential can cause an m/z dependent shift in radial confinement of the ions. In some embodiments, the radial DC potential can radially separate the ions such that ions with a lower m/z ratio are confined closer to a longitudinal central axis of the first rod set. Further, the radial DC potential can cause an m/z dependent shift in a depth of a radial potential well experienced by each of said ions. The depth of the radial potential well can increase as the m/z increases. In various embodiments, the m/z threshold can be selected, e.g., based on a particular application of the ion trap. For example, when precursor ions are trapped to undergo collisional fragmentation to produce product ions of lower mass, the threshold can be selected to be the m/z of the precursor ions such that the fragment ions having a lower mass than the precursor ions can be extracted while the precursor ions are retained in the trap.

In some embodiments, the radial RF potential generates a linear RF quadrupole field and the radial DC potential generates a DC dipole field. In some embodiments, the radial RF potential generates an RF linear hexapole field, and the radial DC potential generates a DC dipole field. In some embodiments, the radial RF potential generates an RF linear octapole field, and the radial DC potential generates a DC dipole field. In some embodiments, the radial RF potential generates an RF linear octapole field, and the radial DC potential generates a DC quadrupole field.

In some embodiments, the radial DC field can be generated by a dipolar DC potential applied between two rods of the first rod set. In some such embodiments, the RF trapping potential can be defined approximately by Equation (1) as given below. In some embodiments, the dipolar DC potential can be defined approximately by Equation (3) as given below. In such embodiments, a total radial trapping potential within said first rod set can be defined approximately by a superposition of said RF trapping potential and said DC dipolar potential according to Equation (4) as given below.

In some embodiments, the method can further comprise selecting the axial bias potential to selectively extract ions having an m/z ratio less than a threshold from said first rod set into said second rod set. In some embodiments, the extraction (ejection) of the ions from said first rod set can be achieved without using resonant excitation of the ions.

In further aspects, the method can further comprise trapping a first group of ions and a second group of ions within the first rod set so as to generate product ions from ion-ion reactions between ions of the first group and ions of the second group, the ions of the first group having an opposite polarity relative to ions of the second group. The method can also comprise selectively extracting at least a portion of the product ions having an m/z less than a first threshold from the first rod set. In some embodiments, the first group of ions comprises reagent anions and the second group of ions comprises analyte cations. In various embodiments, secondary reactions between the product ions and the first group of ions can be inhibited, e.g., via continuous or quasi-continuous extraction of product ions having an m/z less than a threshold. In some embodiments, the ions extracted from the first rod set can be mass selected by the second rod set, e.g., a quadrupole rod set, and be transported to subsequent stages of the mass spectrometer for further analysis. In some embodiments, the method further comprises selectively extracting from the first rod set at least a portion of the product ions having an m/z greater than a second threshold, which can be greater than the first threshold. In this manner, a notched filter can be implemented that can retain precursor ions within the trap but selectively extract ions, e.g., product ions, having m/z ratios lower or higher than that of the precursor ions from the trap. In some embodiments, the extraction of the product ions from the first rod set inhibits secondary reactions between the product ions and the first group of ions.

In some embodiments, the first group of ions comprises reagent anions and the second group of ions comprises analyte ions.

In some embodiments, a mass spectrometer is disclosed, which comprises an ion trap comprising at least one multipole rod set configured to trap a plurality of ions via a radial RF field and a radial DC field. The ion trap further comprises a mechanism adapted to selectively extract ions having an m/z ratio less than a threshold from said first rod set without using resonant excitation. In some embodiments, the mechanism can comprise a voltage source adapted to apply a DC bias voltage to ions within said rod set. In some embodiments, the bias voltage can be at least about 0.5 volts. In some embodiments, the at least one multipole rod set comprises two multipole rod sets positioned in tandem.

In some embodiments, a method of performing mass spectrometry is disclosed which can comprise dissociating at least a portion of a plurality of precursor ions to generate a plurality of product ions, and extracting at least a portion of the product ions from the trap while dissociating at least a portion of the precursor ions remaining in the trap. In some embodiments, the precursor ions can be dissociated via electron transfer dissociation, via electron capture dissociation, and/or via photo-dissociation. In some embodiments, the extracting step can comprise selectively extracting product ions with an m/z less than an m/z of the precursor ions (e.g., an m/z that is at least about 10% less than, at least about 20% less than, at least about 30% less than, at least about 40% less than, and/or at least about 50% less than an m/z of the precursor ions). In some embodiments, the extracting step can comprise selectively extracting product ions with an m/z greater than an m/z of the precursor ions (e.g., an m/z that is at least about 10% greater than, at least about 20% greater than, at least about 30% greater than, at least about 40% greater than, and/or at least about 50% greater than an m/z of the precursor ions).

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DETAILED DESCRIPTION

Figure 1:
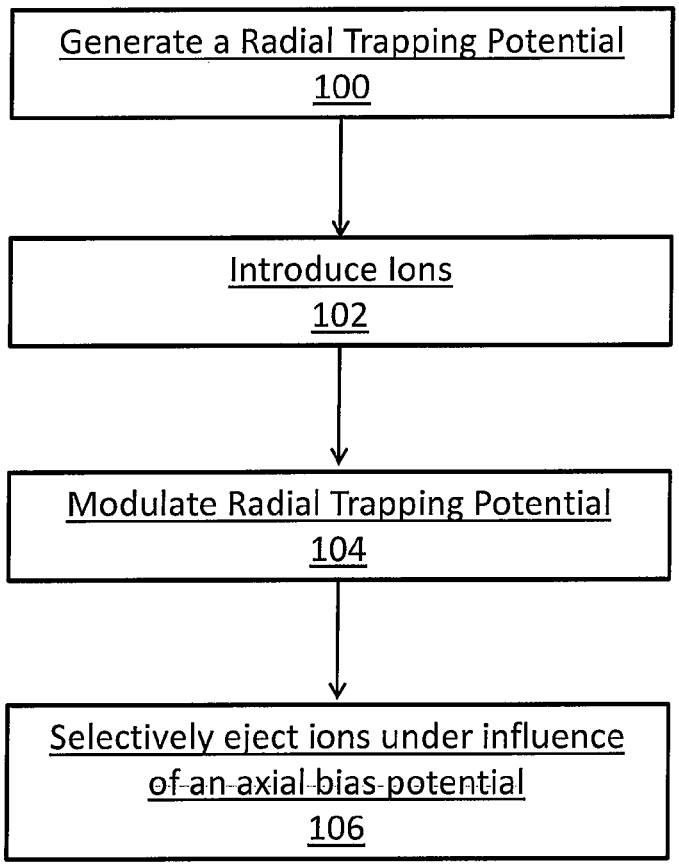
FIG. 1 is a flow chart illustrating various steps for trapping ions in a mass spectrometer according to some embodiments of the present teachings.

FIG. 1 is a flow chart illustrating various steps for trapping ions in a mass spectrometer according to some embodiments of the present teachings, in which at least first and second multipole rod sets are provided that are positioned in tandem, and an RF potential is applied to at least one of the rod sets so as to generate a radial trapping potential within said rod sets (100). In some embodiments, the rod sets are positioned relative to each other such that the RF potential applied to one of the rod sets can be capacitively coupled to the other. In some embodiments, the rod sets are coupled to one another by one or more discrete capacitors. Ions can be introduced into the first rod set, where they are subjected to a radial potential (102). A radial DC potential (e.g., a dipolar potential) can be applied to the first rod set so as to modulate the radial trapping potential generated by the RF potential as a function of m/z of the ions (104). Ions can be trapped in a radial potential that is a superposition of the RF radial potential and the DC radial potential (herein the "total radial potential"). A DC bias potential is applied between the rod sets so as to provide an axial bias potential between the two rod sets. As discussed in more detail below, the dipolar DC potential can cause an m/z dependent shift in the radial position of the ions within the first rod set as well as an m/z dependent shift in the depth of the radial potential wells experienced by the ions. By way of example, in some embodiments, for two ions within the first rod sets that have different m/z values, the depth of the radial potential well is less for the ion having a lower m/z. Thus, in various embodiments, the ions having lower m/z values, e.g., m/z values less than a threshold, can be ejected from the first rod set into the second rod set under the influence of the axial bias potential while those ions having greater m/z values, e.g., m/z values greater than the threshold, remain trapped within the first rod set. In other words, in various embodiments, the lower m/z ions can be selectively ejected from the first rod set without using resonant excitation (106).

Figure 2A:
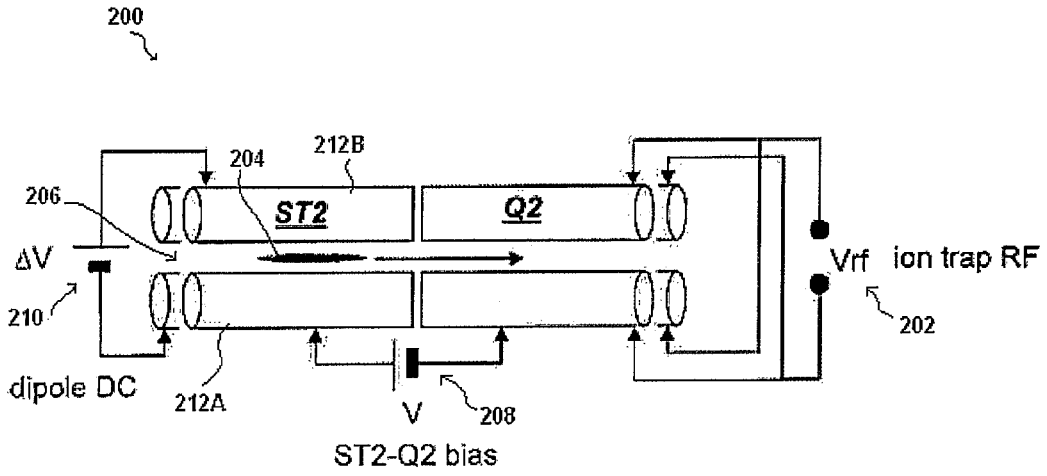
FIG. 2A is a schematic depiction of an ion trap according to some embodiments that can comprise two quadrupole rod sets that are axially aligned in tandem relative to one another and are capacitively coupled to each other.
Figure 2B:
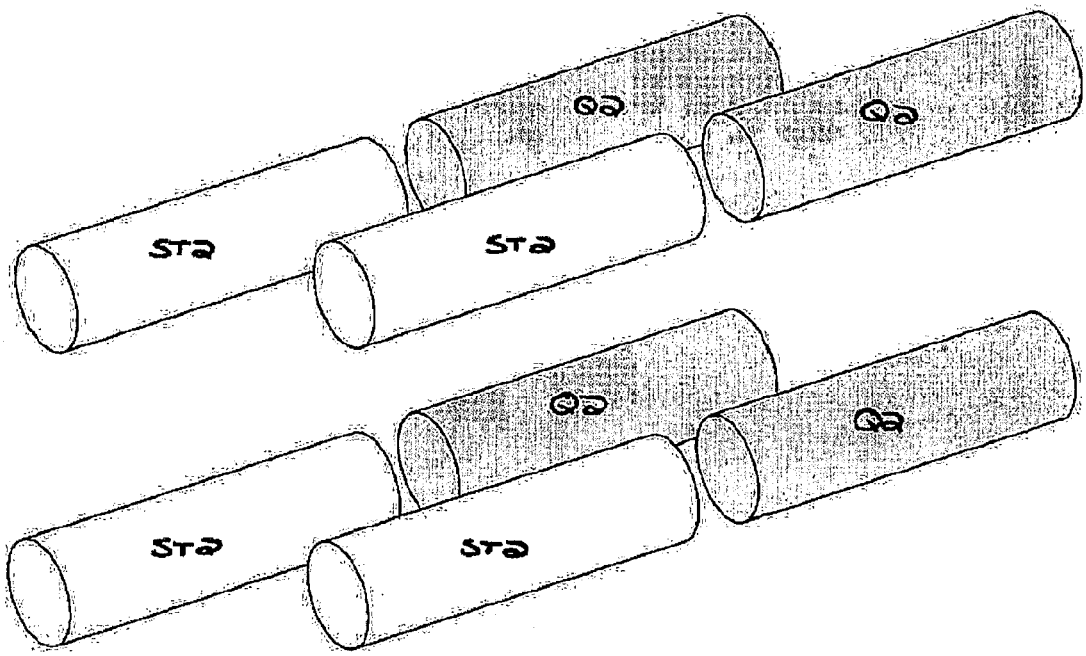
FIG. 2B is a schematic perspective depiction of the two quadrupole rod sets of FIG. 2A.
Figure 10A:
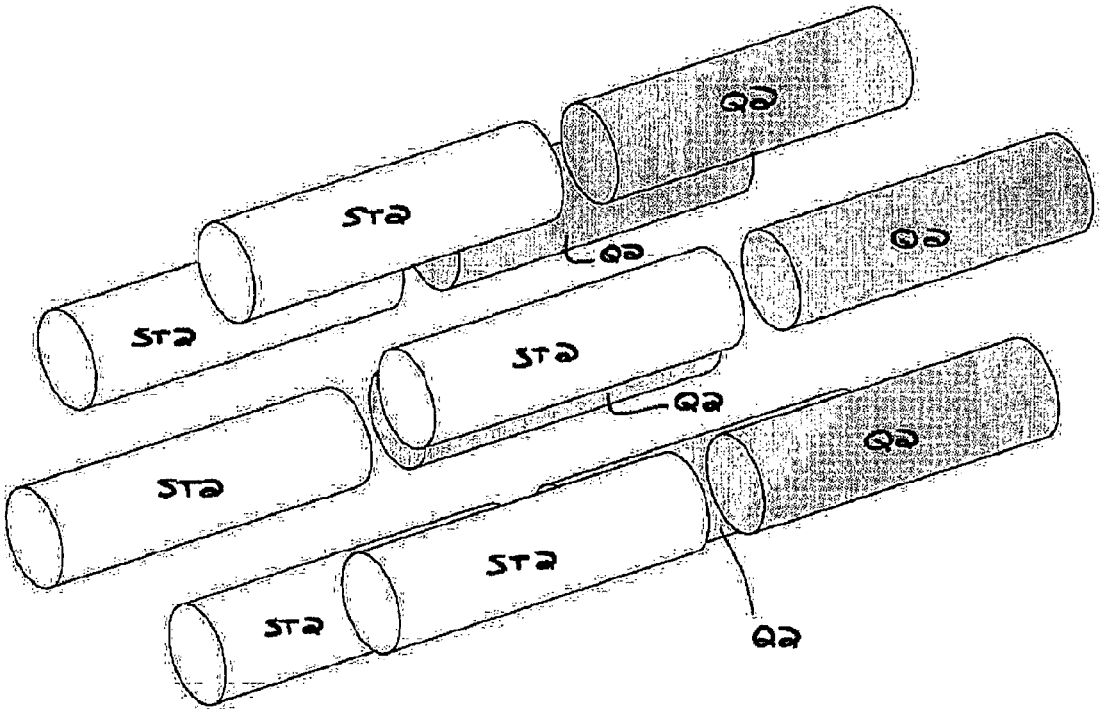
FIG. 10A is a schematic perspective depiction of two hexapole rod sets that are axially aligned in tandem relative to one another and are capacitively coupled to each other; which can be employed in an ion trap according to the present teachings.
Figure 10B:
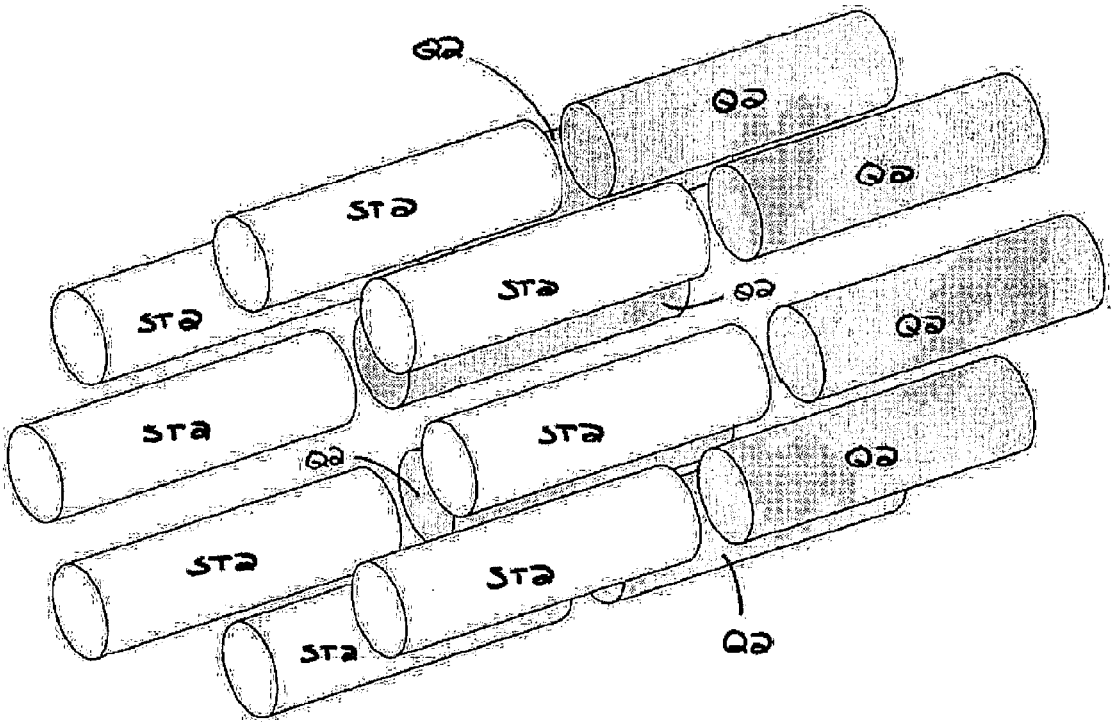
FIG. 10B is a schematic perspective depiction of two octapole rod sets that are axially aligned in tandem relative to one another and are capacitively coupled to each other, which can be employed in an ion trap according to the present teachings.

The methods according to the present teachings can be practiced by using a variety of multipole rod sets. Some examples of suitable rod sets comprise, without limitation, quadrupole (e.g., as shown in FIGS. 2A-2B), hexapole (e.g., as shown in FIG. 10A), octapole (e.g., as shown in FIG. 10B), and so on. In the following, devices according to various embodiments of the present teachings are described in which quadrupole rod sets are employed. It should, however, be understood that the present teachings are not limited to the use of quadrupole rod sets. Further, in some embodiments, one rod set can be one type of a multipole rod set (e.g., quadrupole) and the other rod set can be a different type of a multipole rod set (e.g., hexapole).

FIGS. 2A-2B schematically depict an ion trap 200 according to some embodiments that can comprise two quadrupole rod sets ST2 and Q2 (herein also referred to as quadrupoles ST2 and Q2 for brevity) that are axially aligned in tandem relative to one another and are capacitively coupled to each other. An RF (radio frequency) voltage source 202 is configured to apply an RF potential to the rods of the quadrupole Q2 to generate a radial trapping potential (herein also referred to as a radial confinement potential) within that quadrupole in a manner known in the art. The RF potential applied to each of the rods of the quadrupole Q2 can be capacitively coupled to a respective rod of the quadrupole ST2 to generate a radial trapping potential within that quadrupole as well. A plurality of ions 204 can be introduced into the quadrupole ST2 via an input orifice 206 thereof. Although in this embodiment, a single RF source is employed, in other embodiments, each quadrupole can receive RF potential from its dedicated RF source.

A DC voltage source 208 is configured to apply a DC bias potential across the quadrupoles ST2 and Q2. By way of example, the DC voltage source can apply a DC potential (V) across two respective rods of the two quadrupoles. Alternatively, in some embodiments, the four rods of the quadrupole ST2 can be maintained at one DC voltage and the four rods of the quadrupole Q2 can be maintained at a different DC voltage. The application of the DC potential across the two quadrupoles can generate an axial bias potential that can function as an extractive potential to facilitate the ejection of ions from ST2 for certain ions and can inhibit the ejection of certain other ions having an opposite polarity from the quadrupole ST2 into the quadrupole Q2.

In this illustrative embodiment, another DC voltage 210 is configured to apply a dipolar DC potential (ΔV) between two rods 212A and 212B of the quadrupole ST2. In various embodiments, the dipolar potential ΔV can cause an m/z dependent change in the radial trapping potential within the quadrupole ST2 such that low m/z ions, e.g., ions having an m/z below a threshold, can be extracted from the quadrupole ST2 without resonant excitation while high m/z ions, e.g., ions having an m/z above the threshold, can remain trapped within the quadrupole ST2.

By way of example, in this illustrative embodiment, an RF radial trapping potential (pseudopotential) (Ψ) is applied to both quadruples, which can be defined as a function of distance (r) from a central axis of the quadrupoles as follows:

$$\Psi = \overline{D}\frac{r^2}{r_0^2},\ \overline{D} = \frac{qVrf}{8} \qquad \text{Equation (1)}$$

where, $$q = k\frac{ZeVrf}{mr_0^2\Omega^2} \qquad \text{Equation (2)}$$

where, $V_{rf}$ denotes the RF voltage applied to the rods,

Ω denotes the angular frequency of the RF voltage, m denotes mass of the ion,

Ze denotes the ion charge, $2r_0$ is the distance between the rods, k is constant that depends on definition of $V_{rf}$ in a manner known in the art. Further a dipolar DC potential (Φ) is applied to the rods 212A and 212B of the quadrupole ST2, which is defined in accordance with the following relation as a function of distance (r) from a central axis of the quadruple:

$$\Phi = \Delta V\frac{r}{2r_0} \qquad \text{Equation (3)}$$

where,

ΔV denotes a voltage differential applied across the two rods, and $2r_0$ is the distance between the rods.

Hence, the total radial electric potential, which can be represented as a superposition of the RF radial potential and the DC dipolar potential, can be represented by the following relation:

$$\Psi_{total} = \frac{qVrf}{8}\frac{r^2}{r_0^2} + \Delta V\frac{r}{2r_0} \qquad \text{Equation (4)}$$

The minimum of the radial potential (the depth of the potential) can be represented by the following relation:

$$\Psi_{total} = -\frac{\Delta V^2}{2qVrf} \quad \text{Equation (5)}$$

Further, the radial location of the minimum of the total radial potential can be represented by the following relation:

$$r = -\frac{2\Delta V}{qVrf} r_0 \quad \text{Equation (6)}$$

The above Equation (5) shows that the position shift and depth of potential minimum are less for ions having lower m/z values than for ions having larger m/z values. In other words, within the first quadrupole rod set, the Mathieu stability parameter (q) is larger for small m/z ions and is smaller for large m/z ions. This represents a mass-dependent potential barrier on the axis at the end of the quadrupole ST2. The barrier can be overcome by making the DC offset of the quadrupole Q2 (i.e., the DC bias potential) more attractive to allow ions having m/z values less than a threshold to move into the quadrupole Q2, while higher m/z ions remain trapped in the quadrupole ST2. For example, if the bias DC potential is greater than the magnitude of the minimum (−ψ) of a potential well in which an ion (in this embodiment a cation) is radially confined, $$-\psi\langle V \text{ or } q\rangle \frac{\Delta V^2}{2qVrf},$$

the ion will be extracted from the quadrupole ST2. The threshold value can be adjusted by changing the DC bias potential between the quadrupoles ST2 and Q2. As the stability parameter (q) is inversely proportional to m/z, the threshold for extracted m/z depends linearly on the extraction bias V.

Figure 3:
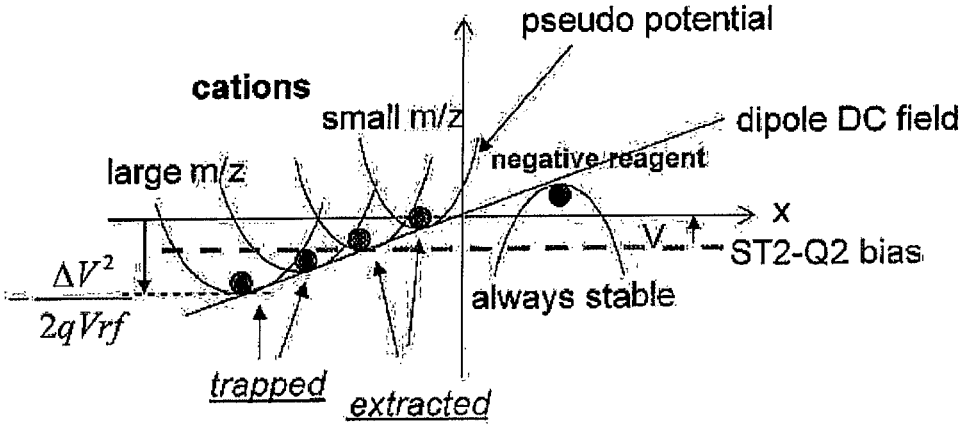
FIG. 3 is a schematic depiction of some embodiments having an axial bias potential such that cations having a small m/z are extracted from the quadrupole, while the cations having a large m/z remain trapped within the quadrupole.

In this illustrative embodiment, as shown schematically in FIG. 3, the axial bias potential can be set such that cations having a small m/z (e.g., m/z less than a threshold) are extracted from the quadrupole ST2 while the cations having a large m/z (e.g., m/z greater than the threshold) remain trapped within the quadrupole ST2. In this illustrative embodiment, the axial bias potential ensures that anions remain trapped within the quadrupole ST2. In other words, mass-dependent selective extraction of cations from the quadrupole ST2 can be achieved. It should be understood that in other embodiments, by switching the polarity of the axial bias potential, selective extraction of anions from the quadrupole ST2 can be achieved while ensuring that cations remain trapped within the quadrupole ST2.

Figure 4:
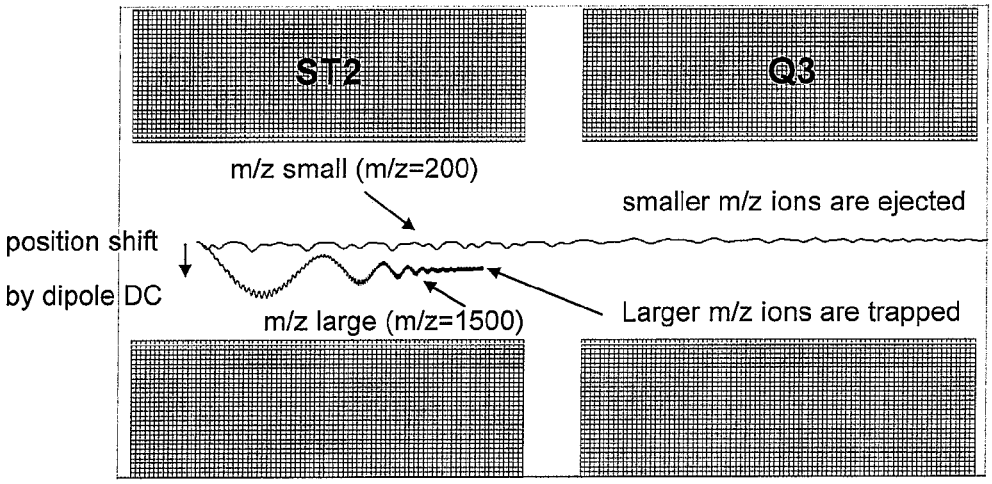
FIG. 4 depicts a theoretical simulation of trapping and extraction of ions in a linear ion trap according to some embodiments of the present teachings.

FIG. 4 shows a theoretical simulation of trapping and extraction of ions in a linear ion trap according to the present teachings using two tandem quadrupole rod sets (ST2 and Q2) showing that cations having an m/z of 200 are ejected from ST2 to Q2 while ions having an m/z of 1500 remain trapped in ST2. In this simulation, the following parameters were employed: $r_0$=2 mm (the distance between the rod set is 2 $r_0$); Vrf=300 volts, Ω/2π=1 MHz, ΔV (DC dipolar voltage)=6 volts, and V (DC bias voltage)=1 volt.

The simulation was performed by using SIMON simulation software marketed by Scientific Instrument Services, Inc of N.J., U.S. A.

In some embodiments, rather than utilizing the second quadrupole set Q2, the axial DC bias potential can be applied to ions within ST2 by employing an electrode disposed in proximity of the exit aperture of the quadrupole ST2. In such embodiments, the RF trapping voltage can be applied directly to the rods of the ST2.

In some embodiments, the above teachings can be employed for performing electron capture dissociation (ECD) and electron transfer dissociation (ETD) reactions (herein collectively referred to as ExD reactions) in a mass spectrometer. For example, in some embodiments, a plurality of reagent anions can be introduced into the first quadrupole ST2, where the DC bias potential between the quadrupole ST2 and Q2 ensures trapping of the anions therein. Subsequently, a plurality of precursor cations can be introduced into the quadrupole ST2 to interact with the anions (e.g., via ETD), e.g., when a pseudo-potential barrier is generated between the rod sets, for example, by application of an AC potential to the rods of ST2 (e.g., See discussion of embodiment of FIG. 6). The ion-ion interactions of the precursor cations with the anions can generate product ions (e.g., fragment ions) having both lower and higher m/z than the precursor ions. At least some of these product ions with lower m/z can then be extracted from the quadrupole ST2 via the bias DC potential to enter quadrupole Q2 when the AC voltage (e.g., AC voltage provided by source 602 in FIG. 6) is set to zero volt. The ejected ions can pass through Q2 to enter other downstream components for mass analysis. In some embodiments, the bias DC potential can be varied to change the threshold for extracting the fragment ions.

In this manner, in various embodiments, the precursor ions can be kept in the trap while the product ions are extracted from the trap, e.g., continuously or quasi-continuously. The bias DC potential allows retaining the anion reagents stably in the trap as the anions are negatively charged and the extraction bias can function as a trapping barrier for the anions. In some embodiments, the precursor ions can be anions and the reagent ions can be cations. In such cases, the present teachings can be applied, e.g., as discussed above, by selecting appropriate voltages (e.g., the polarity of the bias voltage can be reversed relative to the case in which the precursor ions are cations and the reagent ions are anions).

As noted above, conventionally, resonant excitation is employed to extract ions from a trap for low m/z ions. Such resonant excitation, however, can cause collisional excitation of the product ions and change their radical chemistry, e.g. the radical electron on an alpha carbon can migrate to another position. In contrast, in various embodiments of the present teachings, the product ions generated by ExD are extracted without employing resonant excitation. The present teachings can be used not only for ETD and ECD but also for photodissociation of precursor ions, such as infrared multiphoton dissociation (IRMPD).

Figure 5:
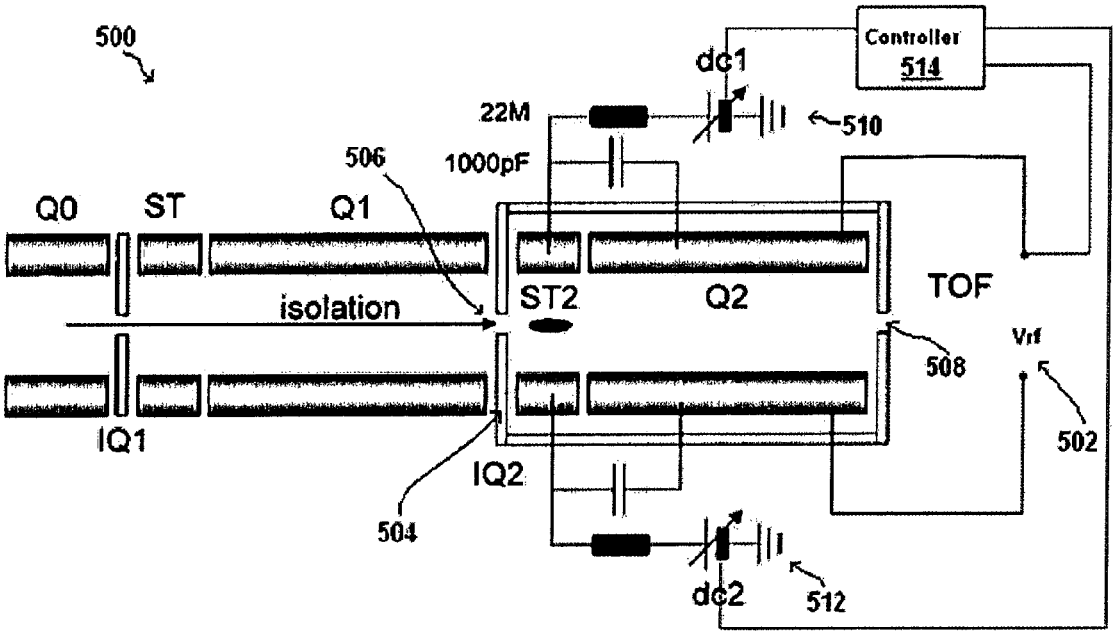
FIG. 5 is a schematic depiction of a mass spectrometer according to some embodiments of the present teachings that comprises a cell for causing dissociation of precursor ions in accordance with the present teachings.

FIG. 5 schematically depicts a mass spectrometer 500 according to an embodiment of the present teachings for causing dissociation of precursor ions in accordance with the present teachings. Ions can enter quadrupole rod set Q0, which can be situated in a vacuum chamber and can be operated as a collision focusing ion guide, for instance by collisionally cooling ions located therein. The ions can then pass through the lens IQ1 to enter the quadrupole Q1, which can be located in another evacuated chamber and can be operated in a mass resolving mode, e.g., as an RF/DC mass filter, e.g., to select a precursor ion having a desired m/z. In this illustrative embodiment, stubby rods (ST) can be employed to focus the flow of ions into Q1.

The illustrative system 500 can further comprise an ion-ion reaction cell 504 in accordance with the present teachings that can comprise two radio frequency quadrupole (RFQ) rod sets ST2 and Q2. The illustrated reaction cell comprises an entrance aperture 506 for receiving ions and an exit aperture 508 through which ions can exit the cell to enter downstream stages of the spectrometer, e.g., a time-of-flight (TOF) mass analyzer. In this embodiment, the quadrupole ST2 is implemented as a set of four stubby rods having, e.g., a length of about 50 mm—in other embodiments the quadrupole ST2 can be implemented differently. The quadrupoles ST2 and Q2 are capacitively coupled to one another, e.g., via 1000 pF capacitors in this embodiment. A DC bias potential between ST2 and Q2 and the dipolar DC potential applied to ST2 are provided by voltage sources 510 and 512. The DC dipolar potential is applied in a gap direction of the RFQ rods ST2. The average of voltages (dc1) and (dc2) applied by the DC voltage 510 and 512 represents the DC bias of ST2, and the difference of dc1 and dc2 (dc1–dc2) represents the dipolar DC voltage, AV. An RF voltage source 502 can apply RF voltages to the ST2 and Q2 quadrupoles to provide radial confinement of ions within those quadrupoles.

A controller 514 can control the DC and RF voltages applied to the quadrupoles ST2 and Q2, including the voltage sources 510 and 512 generating dc1 and dc2.

In use, reagent anions can be introduced into the reaction cell and be trapped therein via the bias DC potential. A plurality of precursor analyte cations can be introduced into the reaction cell to interact with the reagent anions. Such interactions can generate product ions, such as fragment ions via, e.g., ETD and ECD. As discussed above, the dipolar DC potential can shift the radial confinement potential experienced by the precursor and product ions such that the bias DC voltage can cause the ejection of product ions having an m/z less than a threshold from ST2 quadrupole to Q2 while the precursor ions and the anion reagent ions remain trapped. In this manner, the precursor analyte cations can be retained in the trap to continue interacting with reagent anions, while product cations having a lower m/z can be continuously or semi-continuously ejected, thereby reducing secondary ion-ion reactions (e.g., dissociation) between the reagent anions and product cations.

In some embodiments, a combination of low pass filtering as described above and high pass filtering can be implemented to perform notched filtering of precursor ions. In some embodiments, high pass filtering, e.g., extraction of higher m/z ions than precursor ions, can be implemented using the method of RF gating (See, e.g., Baba et al. U.S. Pat. No. 6,852,972, Loboda et al. J. Am. Soc. Mass Spectrom. 2009; 20:1342-8, which is herein incorporated by reference in its entirety). In some embodiments, RF gating can be performed, e.g., by applying an AC field between two RF rod sets to generate a pseudo-potential barrier between those rod sets. Because the barrier has m/z dependence, which can be higher for small m/z ions and lower for larger m/z ions, mass selective extraction for high m/z ions can be achieved.

In some embodiments, by sequential combination of low m/z and high m/z extractions, notched filtering of precursor ions can be realized, e.g. during ETD reaction period.

Figure 6:
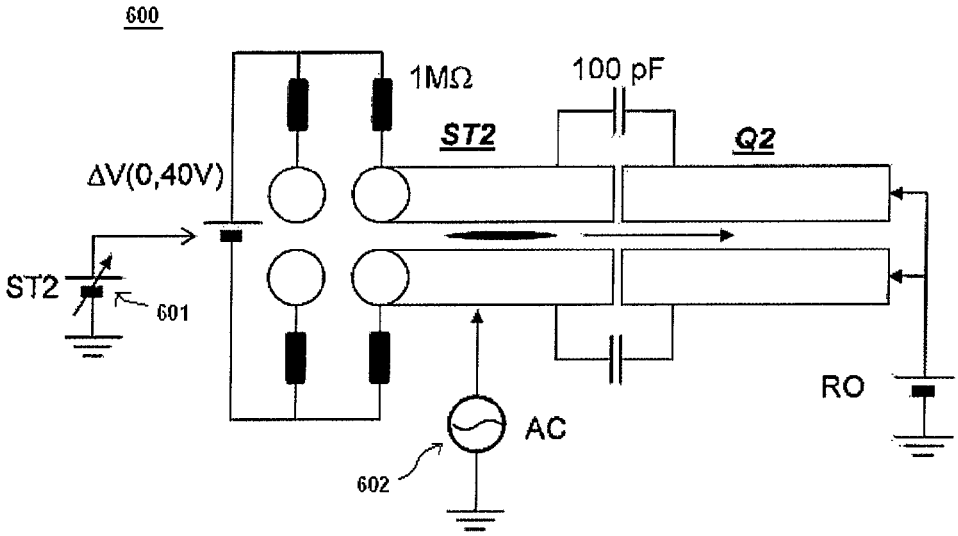
FIG. 6 is a schematic depiction of a mass spectrometer according to some embodiments of the present teachings that comprises a combination of high pass filtering and low pass filtering.

By way of example, FIG. 6 schematically depicts an ion trap according to some embodiments of the present teachings that can provide both low pass as well as high pass filtering of ions. Similar to the previous embodiments, the illustrative ion trap 600 comprises two quadrupole rod sets (ST2 and Q2) that are positioned in tandem and are capacitively coupled to one another, in this embodiment via 100 pF capacitors. A DC bias potential as well as a DC dipolar potential are applied to the rods of the ST2 quadrupole via an adjustable DC voltage source 601 to provide low pass filtering of ions in a manner discussed above. In addition, an AC voltage source 602 is configured to apply an AC voltage to the rods of the ST2 quadrupole to provide a pseudo-potential barrier between the two rod sets via RF gating. Such RF gating can be employed to provide high pass filtering of ions. In some embodiments, the ion trap 600 can be employed in a sequential combination of low m/z and high m/z ion extractions, e.g., during ETD reaction period.

The present teachings are also applicable to inversed ETD, which is complementary version of ETD where negatively charged precursor ions are dissociated by positively charged reagent ions. The dc voltage setting for ETD can be inverted to negative in order to perform inversed ETD.

Aspects of the present teachings can be further understood in light of the following examples, which should not be construed as limiting the scope for the present teachings in any way.

Examples

A triple TOF spectrometer marketed by AB Sciex of Framingham, U.S.A. under trade designation Triple TOF™ 5600 system was modified by replacing its Q2 cell with the reaction cell shown in the system of FIG. 6. In particular, the quadrupole rod set of the Q2 cell of the 5600 was replaced with two separated RFQ rod sets as shown schematically in FIG. 6, where the shorter rod set ST2 has a length of about 50 mm.

Figure 7A:
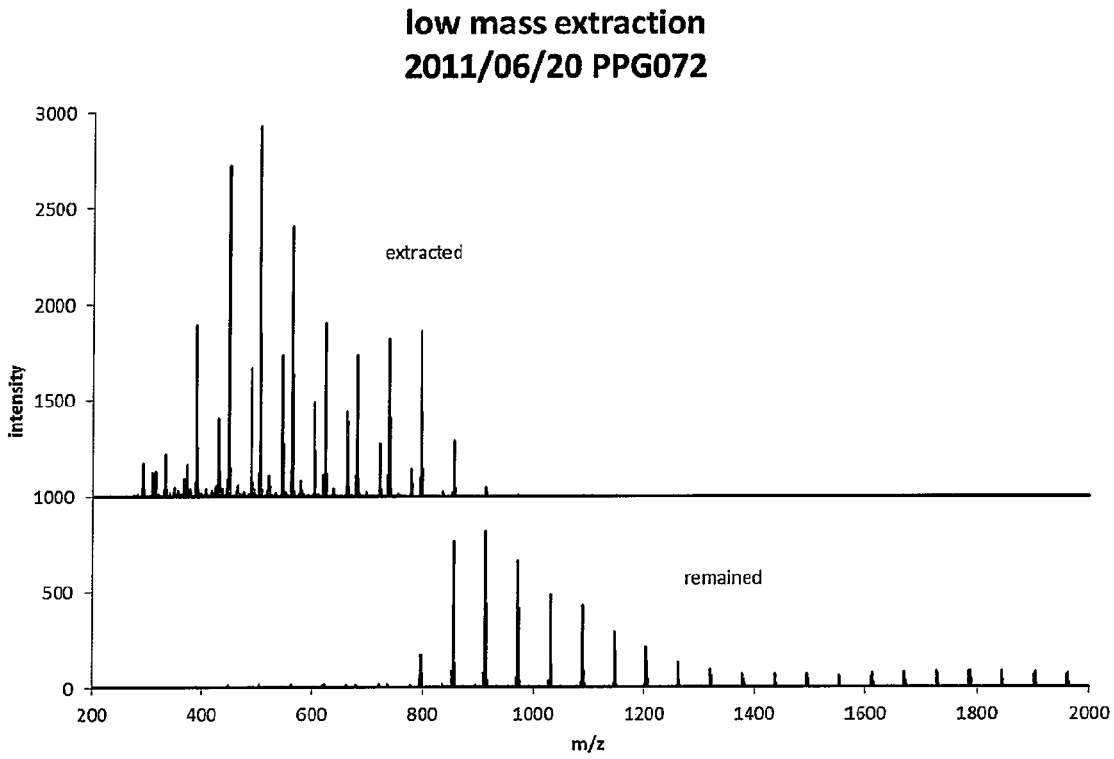
FIG. 7A shows mass selective extraction of polypropylene glycol (PPG)

FIG. 7A shows mass selective extraction of sodiated polypropylene glycol (PPG) ions. Electron spray ionization (ESI) products were used without isolation. A dipolar DC potential (ΔV) of 50 volts (V) and a DC extraction bias potential of 4.25 V were applied. The low mass cutoff (LMCO) of Q2 was 300. The spectrum at the top of FIG. 7A shows m/z ions that were extracted and the spectrum at the bottom of FIG. 7A shows the m/z ions that remained after dipole extraction.

Figure 7B:
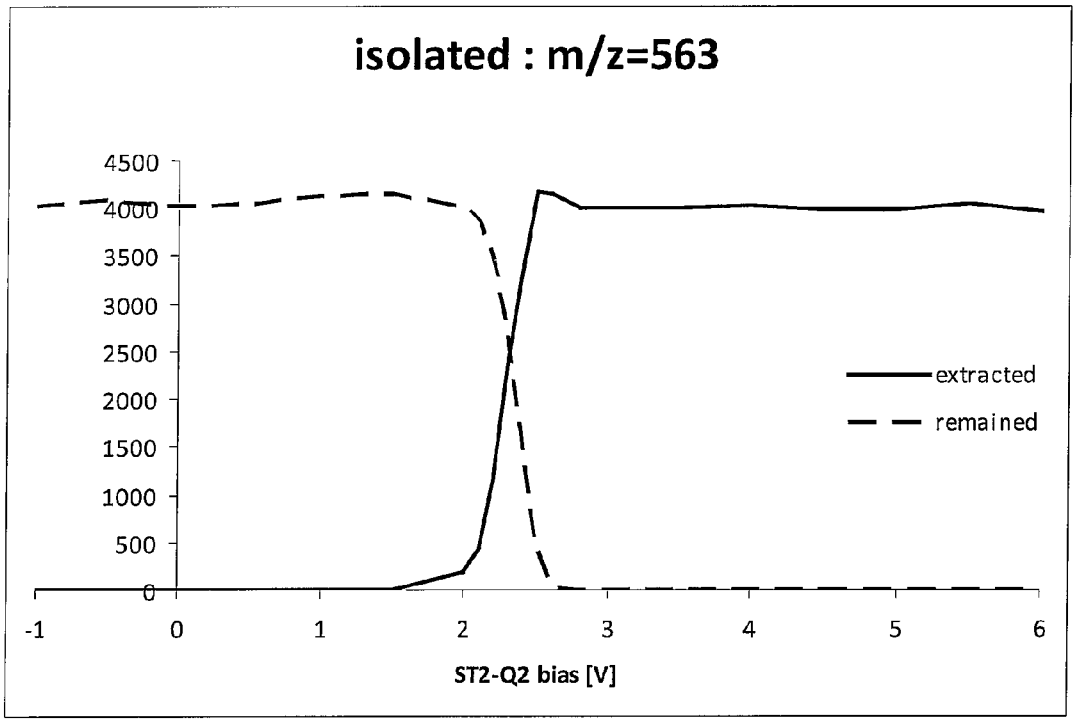
FIG. 7B shows the efficiency of the extraction of polypropylene glycol (PPG) ions and PPG fragments.

FIG. 7B shows the efficiency of the extraction. PPG ions having an m/z=563 were isolated by Q1 and subjected to low mass extraction. The bias DC potential between ST2 and Q2 was scanned while the dipolar DC potential and the RF potential were held constant. Extraction started at a bias DC potential of 2 volts and reached a maximum at a bias DC potential of 2.5 volts.

Figure 8A:
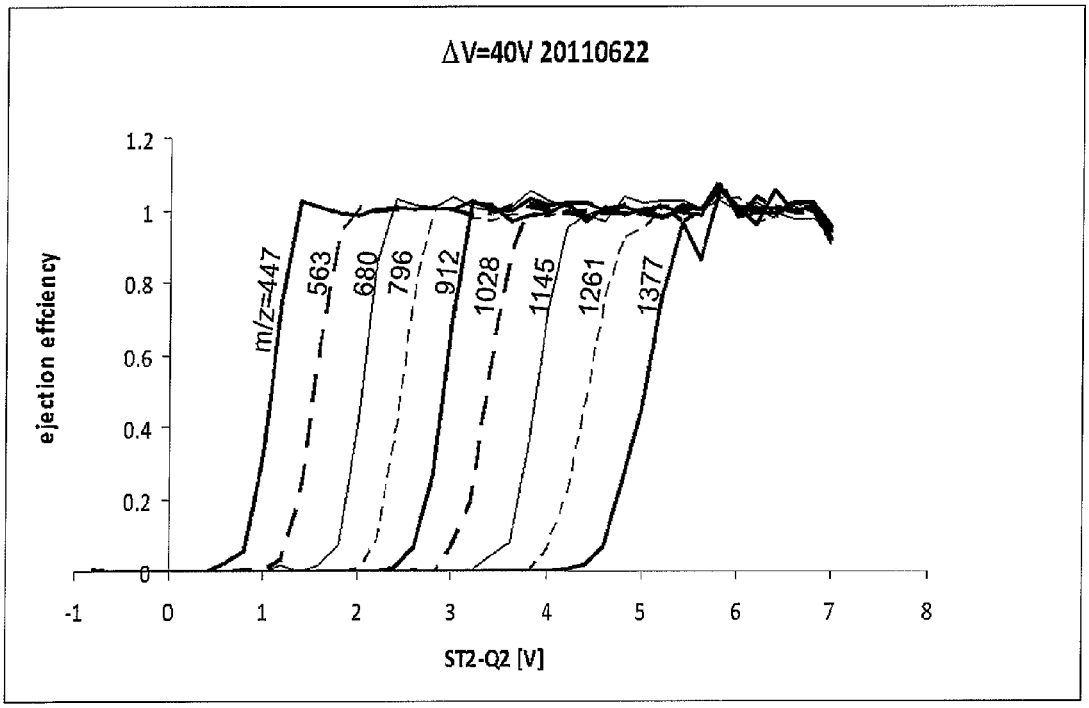
FIG. 8A is a plot of the extraction efficiency v. extraction bias voltage (V for each m/z) for each ESI product of PPG.

FIG. 8A is a plot of extraction efficiency v. extraction voltage (V) for each ESI product of PPG where the sample ions were isolated. FIG. 7A shows the m/z dependence of dipole dc extraction. As is shown, clear m/z dependence is observed.

Figure 8B:
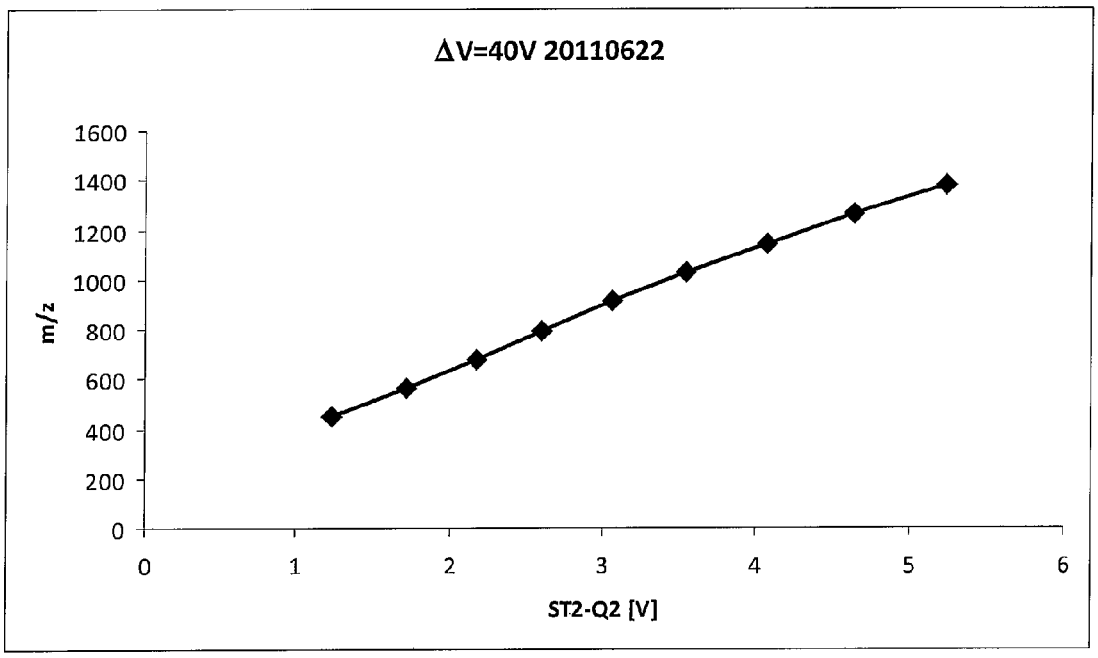
FIG. 8B is a plot of the extraction bias V at 80% extraction efficiency for each m/z showing linearity of threshold extraction voltage V on m/z.

FIG. 8B is a plot of the extraction bias (V) at 80% extraction efficiency for each m/z showing linearity of threshold extraction voltage V on m/z for each ESI product of PPG where the sample ions were isolated. As is shown in FIGS. 7A and 7B, proper extraction bias V for targeting m/z can be determined.

Figure 9:
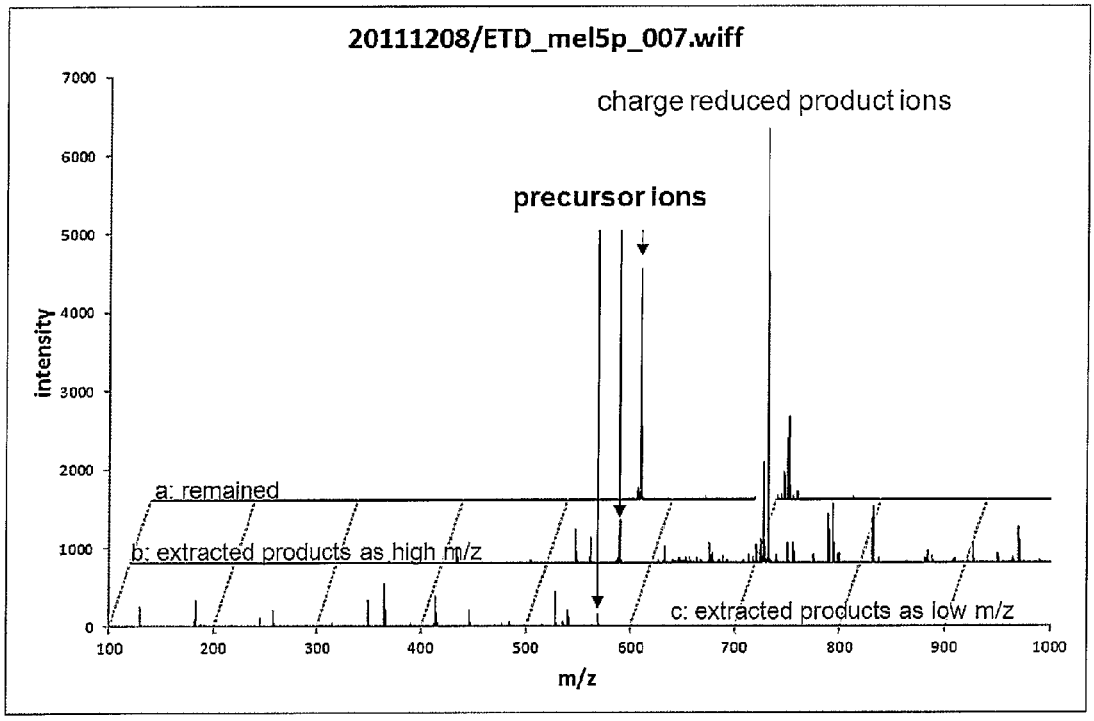
FIG. 9 is a set of ETD spectra of $[\text{mellitin}+5H]^{5+}$ dissociated by an azobenenze anions in an ETD reaction cell according to the present teachings, where the bottom, middle, and top spectra show, respectively, extracted low m/z products, extracted high m/z products and ions that remained in the cell after reaction.

FIG. 9 is a set of ETD spectra of $[\text{mellitin}+5H]^{5+}$, which were dissociated by azobenzene anion as an ETD reagent in an ion-ion reaction cell according to the present teachings The Bottom (c), middle (b) and top (a) spectra show, respectively, extracted low m/z products, extracted high m/z products and ions that remained in the cell after reaction. As is shown, clear m/z dependent extraction is observed in this ETD example.

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. A method for trapping ions in a mass spectrometer, comprising:

providing at least first and second multipole rod sets positioned in tandem, applying a radial RF potential to at least one of said rod sets to generate an RF radial trapping potential within at least said first rod set, applying a radial dipolar DC potential to said first rod set so as to modulate said radial trapping potential as a function of m/z of said ions, applying an axial bias DC potential between said two rod sets to provide an axial bias potential between said two rod sets, and introducing a plurality of ions into said first rod set.

2. The method of claim 1, wherein said radial RF potential generates an RF linear quadrupole field and said radial dipolar DC potential generates a DC dipole field.

3. The method of claim 1, wherein said radial RF potential generates an RF linear hexapole field and said radial dipolar DC potential generates a DC dipole field.

4. The method of claim 1, wherein said radial dipolar DC potential modulates the RF radial trapping potential within said first rod set such that ions within said first rod set having an m/z less than a selected threshold are capable of entering said second rod set under influence of said axial bias DC potential.

5. The method of claim 4, wherein said radial dipolar DC potential modulates the RF radial trapping potential within said first rod set such that ions within said first rod set having an m/z greater than said threshold are trapped within said first rod set.

6. The method of claim 1, wherein said radial dipolar DC potential causes an m/z dependent shift in radial confinement of said ions.

7. The method of claim 1, wherein said radial dipolar DC potential causes an m/z dependent shift in a depth of a radial potential well experience by each of said ions.

8. The method of claim 1, further comprising selecting said axial DC bias potential to selectively extract ions having an m/z ratio less than a threshold from said first rod set into said second rod set.

9. The method of claim 1, wherein said mass selective extraction of ions having an m/z ratio less than the threshold from said first rod set is achieved without using resonant excitation.

10. The method of claim 1, further comprising selectively extracting ions having an m/z higher than a threshold from said first rod set.

11. The method of claim 1, further comprising selectively extracting ions having an m/z ratio lower than a first threshold and selectively extracting ions having an m/z ratio greater than a second threshold from said first rod set while retaining ions having an m/z ratio between said first and second thresholds within said first rod set.

12. The method of claim 1, further comprising:

trapping a first group of ions and a second group of ions within the first rod set so as to generate product ions from ion-ion reactions between ions of the first group and ions of the second group, the ions of the first group having an opposite polarity relative to ions of the second group; and selectively extracting from said first rod set at least a portion of the product ions having an m/z less than a first threshold under influence of said axial bias DC potential.

13. The method of claim 12, further comprising selectively extracting from said first rod set at least a portion of the product ions having an m/z greater than a second threshold.

14. A mass spectrometer, comprising:

an ion trap comprising at least one multipole rod set configured to trap a plurality of ions via a radial RF field and a radial dipolar DC field within said first rod set, a first voltage source for applying the radial RF potential to at least one of said rod sets to generate an RF radial trapping potential within at least said first rod set, a second voltage source for applying the radial dipolar DC potential to said first rod set so as to modulate said radial trapping potential as a function of m/z of said ions, and a third voltage source for applying an axial bias DC potential between said two rod sets to provide an axial bias potential between said two rod sets.

* * * * *